US005666937A

United States Patent [19]

Mendoza-Orozco

[11] Patent Number: 5,666,937

[45] Date of Patent: Sep. 16, 1997

[54] REPEAT-FIRE PELLET RIFLE AND IMPROVED PELLETS

[76] Inventor: Hector Mendoza-Orozco, Fuego 986, colonia Jardines del Pedregal, 01900 Alvaro Obregón, Federal District, Mexico

[21] Appl. No.: 532,146

[22] Filed: Sep. 22, 1995

[30] Foreign Application Priority Data

Mar. 13, 1995 [MX] Mexico ..... 951316

[51] Int. Cl.[6] ..... F41B 11/14

[52] U.S. Cl. ..... 124/67; 124/51.1; 124/53

[58] Field of Search ..... 124/51.1, 52, 53, 124/66, 67, 82

[56] References Cited

U.S. PATENT DOCUMENTS

| | | | |
|---|---|---|---|
| 906,309 | 12/1908 | Schobbert | 124/67 |
| 1,660,127 | 2/1928 | Jonassen | 124/53 X |
| 1,793,625 | 2/1931 | Lefever | 124/52 |
| 1,859,816 | 5/1932 | Decker | 124/53 X |
| 1,862,697 | 6/1932 | Mihalyi | 124/53 X |
| 1,886,704 | 11/1932 | Loomis | 124/52 |
| 2,713,338 | 7/1955 | Abagoff | 124/52 X |

FOREIGN PATENT DOCUMENTS

| | | | |
|---|---|---|---|
| 519142 | 3/1955 | Italy | 124/67 |
| 568929 | 11/1957 | Italy | 124/66 |
| 978502 | 12/1964 | United Kingdom | 124/67 |

*Primary Examiner*—John A. Ricci
*Attorney, Agent, or Firm*—Harrison & Egbert

[57] ABSTRACT

A repeat-fire pellet rifle for sport shooting including a first and second rectangular, slightly curved plate which coincides with the curve of the barrel of the gun. One of the curved plates is located on the upper section and having a central hole which can be used to fix it on the gun barrel. The second curved plate has a central hole which allows it to be fixed on a lower part of the gun barrel. A rectangular plate is located vertically at the side of the ear and compression chamber of the gun. A pellet loader, in the form of a groove, includes a window through which a pellet can be fed. A puller is provided to feed the pellet to the loading chamber.

5 Claims, 5 Drawing Sheets

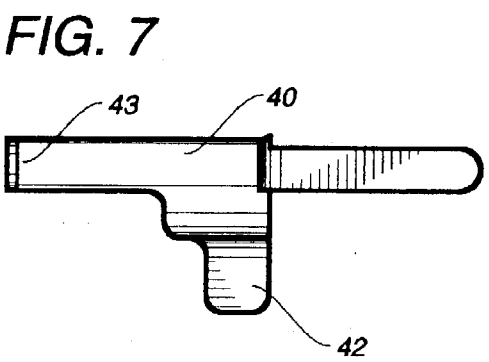
FIG. 6
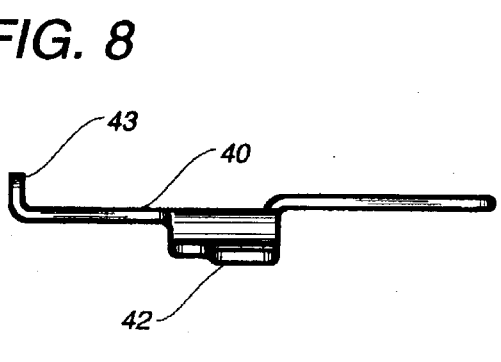
FIG. 8
FIG. 7
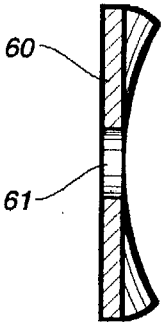
FIG. 10
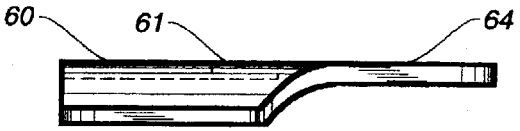
FIG. 11
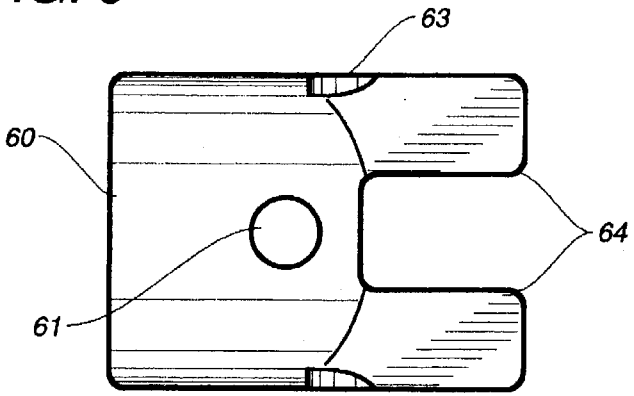
FIG. 9

REPEAT-FIRE PELLET RIFLE AND IMPROVED PELLETS

TECHNICAL FIELD

An addition is presented for locating on pellet rifles, with which the latter may be converted into a repeat-fire rifle.

SUMMARY OF THE INVENTION

The present invention has the advantage that the pieces making up the addition can be quickly and easily located, on any type of pellet rifle, particularly those loaded by opening the rifle and placing the pellet in the barrel.

The parts constituting the device may be summed up in that it is formed by an upper limit, consisting of a steel plate, slightly curved and with appropriate elements for its attachment to the barrel and having at one end two stepped feet which shall be placed on a vertical plate, limiting its movement; a loading plate, consisting of a steel plate, located vertically and next to the firing mechanism, this being formed by the ear, compression chamber and the piston of the rifle, having an upper tongue, and some pushing springs located in lengthwise holes, a lower limiter, consisting of another steel plate, slightly curved and with appropriate fixings, with two feet at one end, joined to the loading plate on which the springs are laid; a pellet loader, formed by a steel channel and with side tongues, also having appropriate elements to fix it to the rifle, as well as a window for the feeding of the modified pellet, with the corresponding geometry for their sole introduction; a puller, consisting of a steel plate with a retractable side lag folded at one end with which the shot is pushed towards the loading chamber; a pushing spring, of the puller, to press the pellets at the same time.

Referring to the modified pellet, this has an aerodynamic form, similar to a hollow, vertical, straight cylinder, nipped half way along its length, with a solid part at its base. This characteristic of the modified pellet, by being hollow from top to bottom, increases the impact area with which greater firing precision shall be achieved. In this way, as the pellets are loaded within the rifle loader in line, the pellet cannot be introduced pint down and at the same time, this avoids jamming.

SCOPE OF THE INVENTION

The basic purpose of this invention is to possess an addition which may be placed on any type of pellet rifles and also ammunition, being able to be converted into a repeat-firing rifle, increasing its capacity.

Another objective of this invention, is the fact of being formed by a minimum number of parts, and being able to be easily and practically installed.

Another advantage is that as the accessory may be installed on a pellet rifle using the minimum number of conventional screws, this saves work during its installation, cleaning or repair.

In summary, this invention has an application field within accessories, devices, and equipment for sport shooting, without this causing any type of restriction, as even though the object was developed for this type of rifles, it is possible to use this invention in other fields with other advantages.

BACKGROUND OF THE INVENTION

There exist on the market pellet rifles which have to be loaded one by one, i.e., there are no repeat-firing rifles for this kind of shot.

Previously attempts have been made to manufacture repeat-firing rifles, which have a small plate for the placing of the pellets, revolving like a revolver. The results have not been very successful, basically due to the jamming of the pellet within the chamber, as well as having very expensive maintenance.

These inconveniences are fully solved by this invention, as in the first place, the pellets are located in line, and will be fed to a loading plate one by one. On the other hand, its cleaning and maintenance is as simple as it could be, as it doesn't require any other adjustments than those necessary for a device of this type. Finally, price comparison is very important, as others have a market price three times greater than the proposed invention.

DESCRIPTION OF THE INVENTION

The characteristics details of this addition for the conversion of a pellet rifle into a repeat-firing rifle, are clearly shown in the following description and in the drawings attached as illustrations and acting as references for the indication of the same parts as in the figures shown.

FIG. 6, is a cross section of the puller.

FIG. 7, is another horizontal view of the puller.

FIG. 8, is a side view of the puller.

FIG. 9, is a horizontal view of the lower limiter.

FIG. 10, is a cross section of the lower limiter.

FIG. 11, is a side view of the lower limiter.

DETAILED DESCRIPTION OF THE INVENTION

Figure 1:
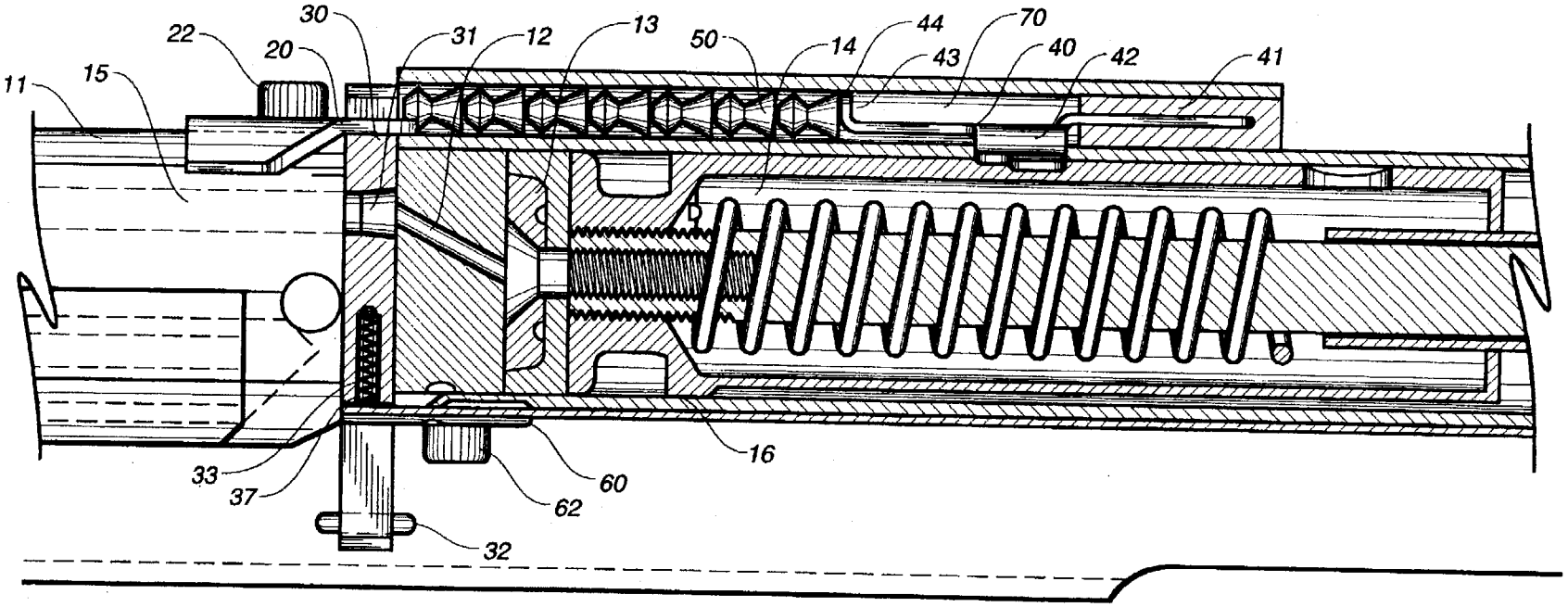
FIG. 1, is a cross section of a rifle showing the addition in place.
Figure 4:
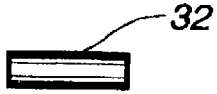
FIG. 4, is a plan view of the limiter bolt.
Figure 5:
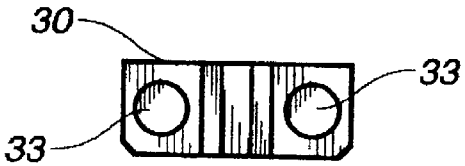
FIG. 5, is another underside view of the vertical plate showing the spring lodgings.
Figure 3:
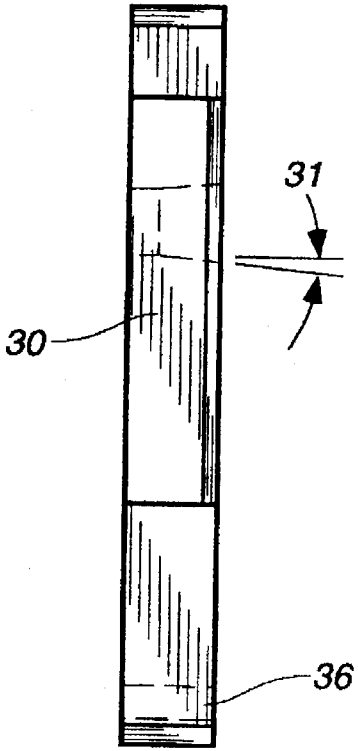
FIG. 3, is another side view of the loading plate.
Figure 2:
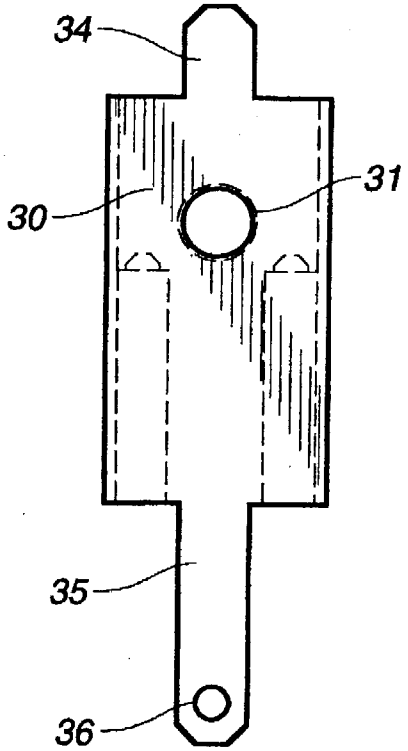
FIG. 2, is a front view of the loading plate.
Figure 14:
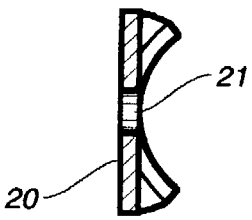
FIG. 14, is a cross section of the lower limiter.
Figure 13:
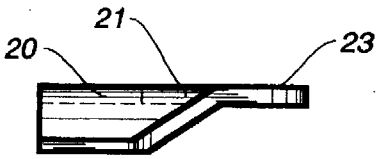
FIG. 13 is another side view of the upper limiter.
Figure 12:
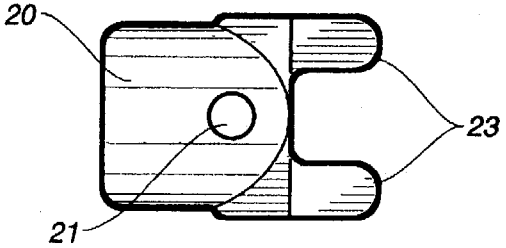
FIG. 12, is a horizontal view of the upper limiter.
Figure 16:
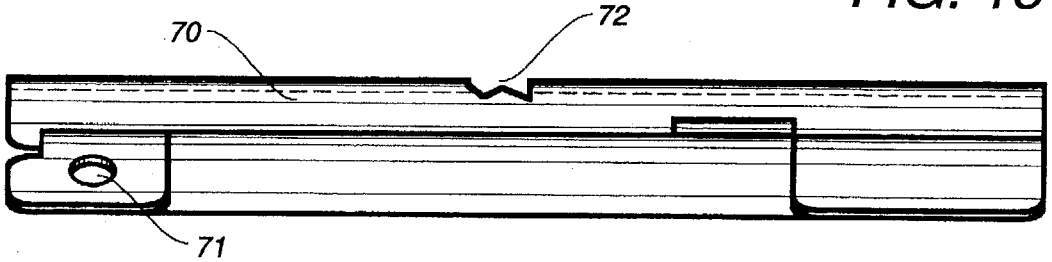
FIG. 16, is a side view of the loader.
Figure 15:
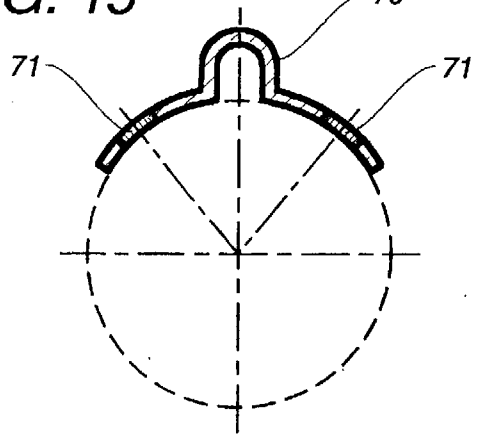
FIG. 15, is a cross section of the loader.
Figure 17:
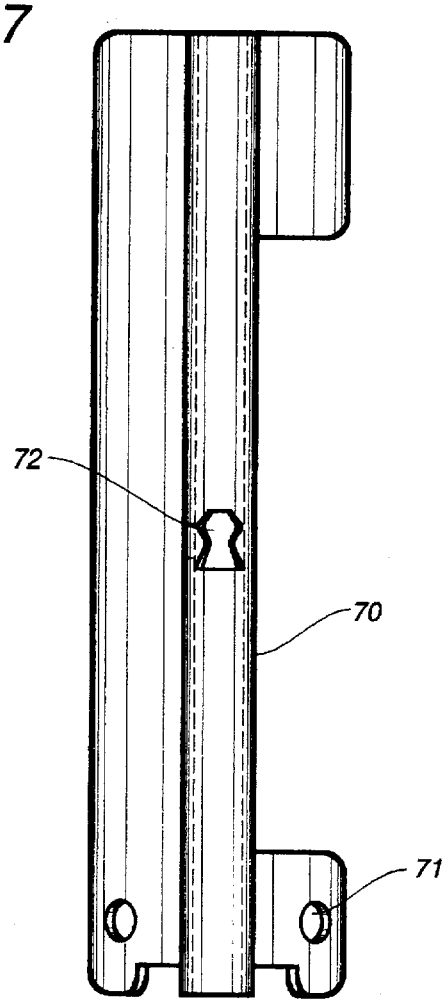
FIG. 17, is a horizontal view of the loader.
Figure 18:
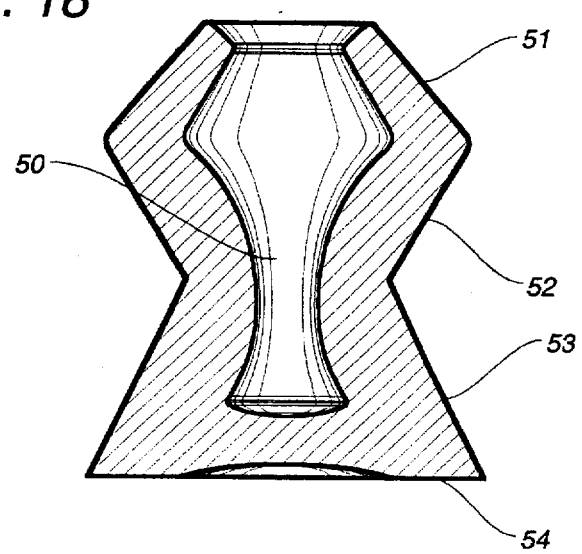
FIG. 18, is a cross section of the modified pellet.

With reference to these figures, the addition for the conversion of a pellet rifle into a repeat-firing rifle, consists of the combination of an upper limiting plate (20), consisting of a plate preferably of steel, slightly curved, following the curve of the guns barrel (11), with a central hole (21), which will be used to fix the device to the gun barrel (11) by conventional means, such as bolts (22). At one end, the upper limiting plate (20) has two stepped fingers (23) which rest on a vertical plate (30) limiting its movement and through whose hollow space will pass an adjusting tongue (34).

A lower limiting plate (60) consisting of a plate, preferably of steel, slightly curved, following the curve of the lower part of the gun barrel (16), with a central hole (61), which will be used to fix the device to the lower part of the gun barrel (16) by conventional means, such as bolts (62). On the side, are adjustment grooves (63) whose purpose is to maintain the lower limiting plate (60) in a fixed position;

towards one end, the lower limiting plate (60) has two curved fingers (64) on which the pushing springs (37) shall rest, and through whose hollow space shall pass an adjustment tongue (35).

A loading plate (30) formed by a plate, preferably of steel, rounded at the front, located vertically in front of the ear (12) and the compression chamber (14) of the gun, rectangularly, with a central hole (31) which shall form the loading chamber for the modified pellets (50), being formed by a cylindrical hole and which a third of the way along the plate becomes a conical hole; towards the upper part of the plate (30) protrudes an upper tongue (34), which shall pass through the hollow in the stepped fingers (23) and at the same time, shall cover the exit of the modified pellets (50); and towards the lower part protrudes a lower tongue (35), with a central hole (36) through which a movement limiting bolt (32) will be installed limiting the movement of the loading plate (30), and with the characteristic of this lower tongue (35) passing through the slot between the fingers (64). A plurality of bores (33) are formed in the plate (30) adjacent the lower plate (60). These bores (33) receive springs (37) therein. These springs (37) push on the lower plate (60) so as to urge the vertical loading plate (30) into an upward position.

A loader for modified pellets or ammunition (70) preferably made from steel plate, in the form of a groove, with an appropriate length, containing side tongues with the same geometry as the gun barrel (16), with fixing holes (71) on each side, with an upper window (72), of a geometry corresponding to the modified pellet (50) and in this way the pellet can only be introduced in only one way. The window (72) is positioned at approximately one-half the length of the loader (70).

A puller (40) to directly feed the modified pellet (50) to the loading chamber (31), includes a plate preferably of steel, with a side leg (42) of an appropriate length to be retracted by hand, a fold at one end forming the pusher (43) which is adjusted at the opposite end to the pusher (43), keeping the modified pellets (50) under pressure all the time.

With reference to the modified pellet (50), this is made up of an aerodynamic body, from a straight cylinder, hollow inside, nipped half way along its length, imitating a type of flat arrow, and which can be divided into an upper cone (51) joined at the base with another cut middle cone (52), joined once again to another lower cone (53). The upper cone (51) and the middle cone (52), are hollow, as has already been mentioned, with which the modified pellets will be of an expansive type. The base of the lower cone (53), has been modified, with a solid base towards the lower part (54) and in this way, when the pellets are placed in the loader (70), they shall be lined up and the point will not be inserted in the following one, thus avoiding jamming.

Regarding their use, this is simple as it can be, as once the pieces that make up the addition are in place, the modified pellets (50) are then used to fill the loader (70), the gun now becoming a repeat-fir rifle. In effect, the rifle is opened and closed in order to fire at the target and so on.

I claim:

1. A loading apparatus for fixing to a barrel of a pellet rifle for sport shooting comprising:

a rectangular curved upper plate having means thereon for fixing said upper plate to the barrel, said upper plate having a pair of fingers extending outwardly therefrom;

a rectangular curved lower plate having means thereon for fixing said lower plate to the barrel, said lower plate having adjustment grooves formed thereon so as to maintain said lower plate in a fixed position relative to the barrel, said lower plate having a pair of fingers extending outwardly therefrom;

a rectangular vertical loading plate having a central bore hole, said loading plate having an upper tongue and a lower tongue, said upper tongue being slidably received between said pair of fingers of said upper plate, said lower tongue being slidably received between said pair of fingers of said lower plate, said loading plate having a hole formed in said lower tongue through which a limiting bolt extends, said limiting bolt positioned below said lower plate, said loading plate having a plurality of bores formed therein, each of said plurality of bores receiving a spring therein, said spring contacting said lower plate so as to urge said loading plate upwardly;

a pellet loader having means thereon for fixing said pellet loader to the barrel, said pellet loader having an ammunition exit at one end, said upper tongue being positioned so as to cover said ammunition exit when said loading plate is in an upward position, said pellet loader having a window means formed at approximately half of a length of said pellet loader, said window means for allowing a pellet to be introduced into said pellet loader; and a puller means for feeding the pellet from said pellet loader into the barrel, said puller means comprising a pusher plate having a side leg extending outwardly therefrom, said pusher plate having a folded end extending into said pellet loader so as to push the pellets through the pellet loader, said pusher plate having a spring means affixed to an end opposite said folded end for urging said folded end toward said lower plate.

2. The apparatus of claim 1, said central bore hole of said loading plate being of cylindrical shape at one end and of frustoconical shape at an opposite end, said frustoconical shape being adjacent said pellet loader when said loading plate is in the upward position.

3. The apparatus of claim 1, said loading plate being movable between a first position in which said central bore hole is aligned with said ammunition exit of said pellet loader and a second position in which said central bore hole is aligned with an entry into the barrel.

4. The apparatus of claim 1, said puller means being movable between a first position closing said window means and a second position which allows introduction of a pellet through said window means.

5. The apparatus of claim 1, said window means having a shape similar to a shape of a pellet to be introduced therethrough.

* * * * *